United States Patent [19]

Wallin

[11] Patent Number: 4,675,479

[45] Date of Patent: Jun. 23, 1987

[54] SAFETY SWITCH ASSEMBLAGE

[76] Inventor: Kenneth M. Wallin, 359 Humboldt St., Brooklyn, N.Y. 11211

[21] Appl. No.: 853,926

[22] Filed: Apr. 21, 1986

[51] Int. Cl.[4] ..... H01R 19/50

[52] U.S. Cl. ..... 200/51.11; 200/51.05; 200/51.08; 200/51.13

[58] Field of Search ..... 200/51.11, 51.08, 51.03, 200/51.05, 51.06, 51.07, 51.09, 51.1, 51 R, 330, 51.12, 51.13, 51.02

[56] References Cited

U.S. PATENT DOCUMENTS

| | | | |
|---|---|---|---|
| 421,586 | 2/1890 | Kookogey | 200/51.05 |
| 750,720 | 1/1904 | Springall | 200/51.06 |
| 3,046,515 | 7/1962 | Appleton | 200/51.08 |
| 4,438,303 | 3/1984 | Astier | 200/51.11 |

*Primary Examiner*—Stephen Marcus

*Assistant Examiner*—Renee S. Luebke

*Attorney, Agent, or Firm*—Howard M. Schwinger

[57] ABSTRACT

A safety switch assemblage consisting of a switch housed within a protective casing and having a manually operated control at one end and terminals extending from the other end, the switch carrying a circuit which by-passes the switching circuitry and presents terminals which extend outwardly from the side of the switch, a socket for the switch, the socket having terminals at its base for internal connection with the switch terminals and external connection with a component, the socket having terminals in its side wall in electrical connection with its other terminals so that when the switch is partially withdrawn from the socket primary electrical connection is broken and secondary electrical connection may be optionally established by the union of by-pass terminals with the terminals in the side wall of the socket.

3 Claims, 1 Drawing Figure

SAFETY SWITCH ASSEMBLAGE

Figure 1:
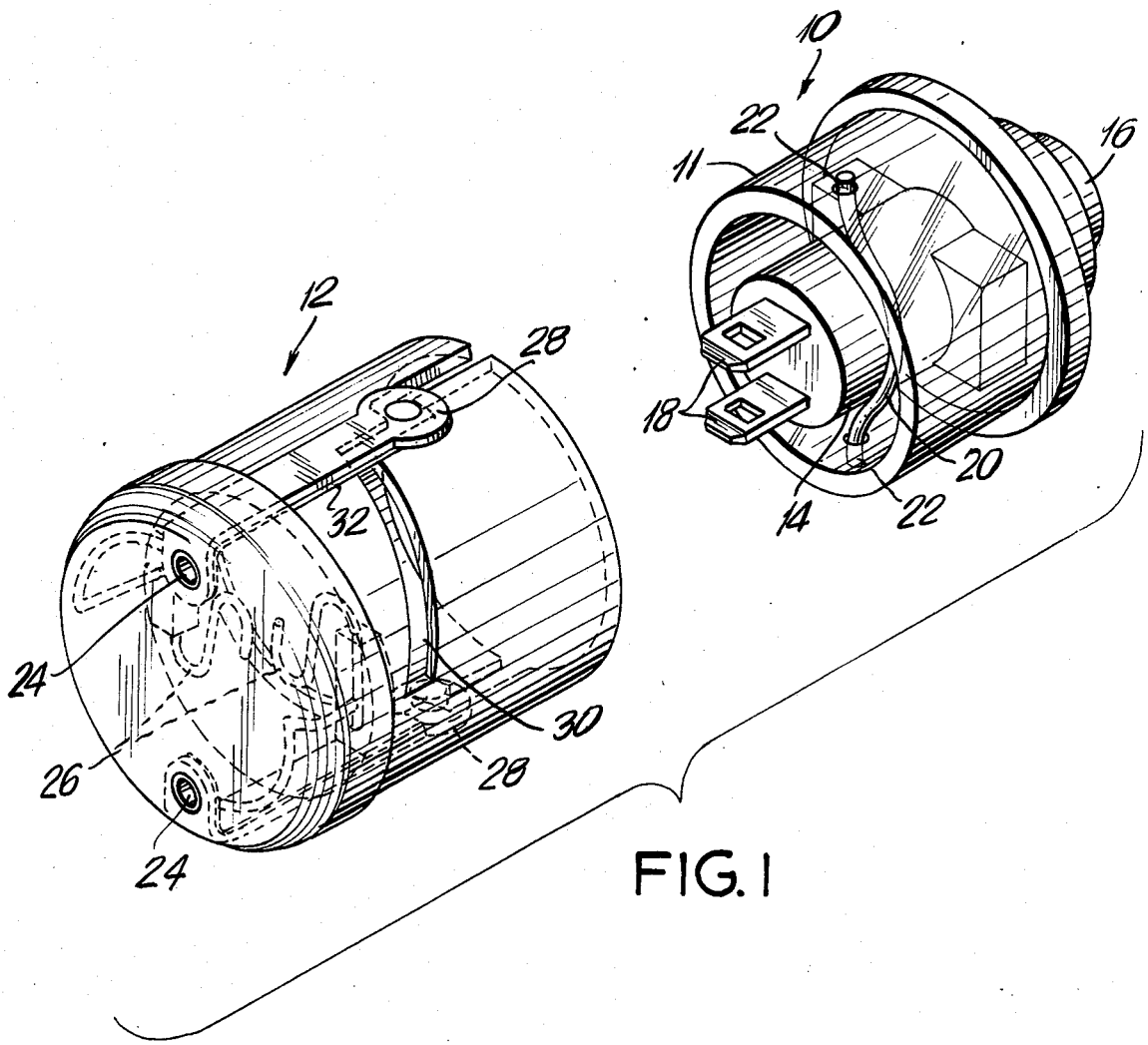

This invention relates to switches and more particularly, to industrial type switches having a fail safe feature.

Switch failure in industrial machines presents a multitude of problems all brought on because in the event of failure, the switch cannot be turned off. In this event the machine would have to be turned off at the power source resulting in a time loss which may have dire consequences.

It is thus a primary object of the present invention to provide a switch which can be turned off at the switch situs in the event of failure.

It is another important object of the present invention to provide a switch which, in the event of failure, can still be utilized.

Other objects and advantages of the present invention will become apparent from the following specification and drawing wherein:

FIG. 1 is an exploded view of an embodiment of a switch in accordance with the present invention.

An embodiment of the invention is shown in FIG. 1 consisting of switch 10 and socket 12. The socket is non-conductive. The switch may carry a non-conductive sleeve 11 to insure a tight telescoping fit of switch within socket. The assemblage is dust proof and water proof.

The switching circuitry is housed within protective casing 14 and is therefor not visible. The switch is provided with the usual control button 16 at one end and terminals 18 extending from its other end. The switch carries an auxiliary circuit 20 which presents terminals 22 which extend laterally of the switch and its sleeve. Circuit 20 electrically by-passes the switching circuitry.

Socket 12 has terminals 24 and 26 at its base. Terminals 24 are for external connection with a machine or electrical component (not shown). Terminals 26 are for internal connection with switch 10. The terminals are in electrical connection with each other making up two sets of interconnected terminals which may be joined electrically by switch 10.

The assemblage is adapted to be inserted in an opening or recess of a machine component which should be suitably insulated to receive the instant assemblage.

Socket 12 is also provided with terminals 28 in its side wall as may be seen in the drawing. Terminals 28 are in electrical connection with terminals 24 and 26, the connection being electrically shielded by insulation 32. Thus two sets of three interconnected terminals are presented. The sets are electrically joined by the switch.

The socket is provided with slots 30 which act as tracks for guiding switch 10 in and out of electrical connection with the socket base and for guiding terminals 22 into electrical connection with terminals 28.

As may be seen, terminals 22 extend into slots 30 and act to cam switch 10 in and out of the socket. By virtue of the configuration of the slots, the switch is cammed in and out of the socket by a manual twisting motion.

Thus if the switch fails and cannot be turned off by depressing its control button, its connection with the socket may easily be broken by partially withdrawing the switch from the socket.

If it is desired to resume operation, the switch is pulled outwardly of the socket until terminals 22 make contact with terminals 28. The switch may be operated manually in this mode with connection and interruption being manually made.

Thus primary connection is broken by twisting the switch and secondary connection established by pulling the switch in this embodiment of the invention.

It is to be realized that the embodiment herein described is but one of many that can utilize the principles of the present invention and it is not intended to limit the invention to this specific embodiment as the invention encompasses all embodiments falling within the scope and spirit of the appended claims.

I claim:

1. A safety switch assemblage comprising a switch housed within a protective casing and having a manually operated control at one end and terminals extending from the other end, said switch carrying a circuit which by-passes the switch and presents terminals which extend laterally of the switch, a socket for said switch, said socket having terminals at its base for internal connection with the switch terminals and external connection with a component, the socket having terminals in its side wall in electrical connection with its other terminals so that when the switch is partially withdrawn from the socket primary electrical connection is broken and secondary electrical connection may be optionally established by the connection of by-pass terminals with the terminals in the side wall of the socket.

2. A device in accordance with claim 1 wherein the side wall of the socket is slotted, the by-pass terminals extend into the slots and are confined thereto to direct movement of the switch, said slots presenting tracks for guiding the switch in and out of electrical connection with the socket base and further, for guiding the by-pass terminals into electrical connection with the terminals in the side wall of the socket.

3. A device in accordance with claim 2 wherein the slots are so arranged that primary connection is broken by twisting the switch and secondary electrical connection established by pulling the switch.

* * * * *